US005528894A

United States Patent [19]

Werner

[11] Patent Number: 5,528,894

[45] Date of Patent: Jun. 25, 1996

[54] TEXTILE MACHINE PARAFFING DEVICE

[75] Inventor: Schmolke Werner, Ingolstadt, Germany

[73] Assignee: Rieter Ingolstadt Spinnereimaschinenbau AG, Ingolstadt, Germany

[21] Appl. No.: 319,938

[22] Filed: Oct. 7, 1994

[30] Foreign Application Priority Data

Nov. 11, 1993 [DE] Germany ..... 43 38 453.6

[51] Int. Cl.[6] ..... D01H 13/26; D01H 13/30

[52] U.S. Cl. ..... 57/296; 57/297; 118/78; 427/11

[58] Field of Search ..... 57/295, 296, 297, 57/400; 118/78, DIG. 22; 427/11; 28/217

[56] References Cited

U.S. PATENT DOCUMENTS

| | | | |
|---|---|---|---|
| 686,461 | 11/1901 | Keats | 118/78 |
| 752,458 | 2/1904 | Lehman | 118/78 |
| 839,567 | 12/1906 | Emerson | 118/78 |
| 1,230,714 | 6/1917 | Houston | 118/78 |
| 2,235,229 | 3/1941 | Lytton | 118/78 |
| 2,477,422 | 7/1949 | Roseman | 118/78 |
| 3,479,988 | 11/1969 | Trost et al. | 118/78 |
| 3,941,897 | 3/1976 | Vecchia | 427/11 |
| 4,244,176 | 1/1981 | Shimizu | 118/78 |
| 4,345,542 | 8/1982 | Hauner | 118/78 |

FOREIGN PATENT DOCUMENTS

| | | | |
|---|---|---|---|
| 2939281 | 4/1981 | Germany | 57/295 |

*Primary Examiner*—William Stryjewski
*Attorney, Agent, or Firm*—Dority & Manning

[57] ABSTRACT

The paraffining device on a textile machine with a fixed paraffin piece is provided with a covering which prevents small paraffin particles which may be produced by rubbing of the yarn, for example, from leaving the area of the paraffining device and thus preventing interference with the spinning or winding process.

11 Claims, 2 Drawing Sheets

TEXTILE MACHINE PARAFFING DEVICE

BACKGROUND OF THE INVENTION

The instant invention relates to a paraffining device. Such a paraffining device is known from DE 34 22 814 A1 for example. In the known paraffining device, a yarn to be covered with a layer of paraffin runs over a fixed paraffin piece which is mounted rotatably, the axle of rotation being perpendicular to the running direction of the yarn. The arriving yarn is guided over the front of the paraffin piece so that a thin coat of paraffin on the yarn results. In order to ensure even coating, care is taken for the paraffin piece to remain always in the same position in relation to the course of the yarn, even when it becomes smaller due to the removal of paraffin. To ensure this, the paraffin piece is mounted on its axle of rotation so that it can be shifted. A stop is provided here by which the paraffin piece is pressed in the direction of the yarn by means of a spring. The contact between the yarn and the paraffin piece takes place on the front of the latter. Due to the fact that it rotates slowly around an axle that is perpendicular to the direction in which the yarn runs, the front of the paraffin piece is given a convex surface. As appears from DE 34 22 814 A1, paraffining devices are used also on bobbin-producing machines, in the immediate proximity in front of the yarn wind-up. In rotor spinning machines for example, where fiber sliver coming out of a presentation can is twisted into a yarn by means of a spinning rotor, the paraffining device is located between the rotor box in which the yarn is twisted and the winding device.

In paraffining the yarn, paraffin is removed from the paraffin piece through friction, whereby smaller or larger paraffin particles are rubbed off depending on the hardness of the paraffin piece and which do not adhere to the yarn but leave the area of the paraffining device in the form of free paraffin particles which cause malfunctions in the textile machine. Also, paraffin which has already been applied may be rubbed off again at yarn deflection points, in particular if these are located directly within the yarn course following the paraffin clump. These free paraffin particles cause the spinning or winding device to be soiled. This soiling may lead to disturbances of the spinning and winding process. For example, these free paraffin particles may enter the presentation cans together with the presentation sliver on open-end spinning machines. Thereby they continue into the yarn-forming zone of the rotor where they may cause interference in the yarn forming process and even yarn breakage.

With rotor spinning machines in particular, it was found through experience in the past that in the production of yarns out of a given starting material an increased number of yarn breakages occurred during paraffining, with considerably adverse effect on the economy of yarn production. Yarns made of viscose in particular were not paraffined on rotor spinning machines for this reason. When a presentation sliver of pure cotton was used however, no significant errors in the yarn formation were found with the same paraffining device. It has now been found that the free paraffin particles which reached the presentation can are responsible for this.

OBJECTS AND SUMMARY OF THE INVENTION

It is a principal object of the present invention to design a paraffining device in such a manner that, as much as possible, no paraffin particles enter the area of a spinning or winding machine where they could lead to disturbances of the process. Additional objects and advantages of the invention will be set forth in part in the following description or may be obvious from the description, or may be learned through practice of the invention.

The covering according to the invention makes it possible to catch the free paraffin particles when they have been torn off from the paraffin piece or have been rubbed off by the yarn, so that they cannot cause soiling of the machine or interference in a yarn forming process, for example. The free paraffin particles are collected instead, so that they can be removed from the covering at regular intervals. The covering according to the invention makes it now possible to paraffin also those yarns which could not be produced economically in the past on the rotor spinning machines. The high number of yarn breakages in the past when using such materials can be reduced to a normal number, such as would occur without paraffining, for example. The utilization of a more brittle paraffin is now possible, because soiling of the machine and interference with the production process can be prevented effectively.

It is advantageous for the covering of the paraffin piece to be formed of at least two surfaces which cover the two sides of the paraffin piece, and especially advantageous if they are essentially perpendicular to each other. This makes it possible to cover the bottom as well as the front of the paraffin body. The covering on the- bottom is especially advantageous because the free paraffin particles, following gravity, most often fall down. The covering at the front is advantageous because, in a rotor spinning machine, the free paraffin particles carried along by the running yarn generally fall away from the front of the paraffin clump and the machine to where the cans with the presentation sliver are standing, for instance.

It is especially advantageous for the covering to be provided with an opening for the passage of the yarn, this opening being located before the paraffin piece, in the running direction of the yarn. This makes it possible for the yarn to find access to the paraffin piece without interference by the covering while making it possible to provide covering on all sides of the paraffin piece. With this design of the covering, the operations at the spinning station are advantageously unimpaired.

By providing a covering shutter in the area of the yarn insertion opening, free paraffin particles are advantageously prevented from coming out of the covering through the yarn insertion opening. If the covering in the vicinity of the yarn insertion opening is made as a yarn catching device, it affords an especially simple possibility to bring a yarn which is handled outside the covering back into its normal position. It is especially advantageous for the covering shutter and the yarn catching device to be made in one assembly. It is especially advantageous and safe for operation if the yarn insertion opening is integrated into the surface of the covering which is in a plane parallel to the plane formed by the yarn going back and forth. The result of this is that the yarn reaches the area of the yarn insertion opening without much deflection so that it can be brought again into contact with the paraffin piece rapidly and reliably. Additional advantageous developments of the invention are described in the following description.

The invention is described below through drawings.

DETAILED DESCRIPTION OF THE PREFERRED EMBODIMENTS

Reference will now be made in detail to the present preferred embodiments of the invention, one or more examples of which are illustrated in the accompanying drawings. Each example is provided by way of explanation of the invention, and not as a limitation of the invention. The number of components is consistent throughout the application, with the same components having the same number in each of the drawings.

Figure 1:
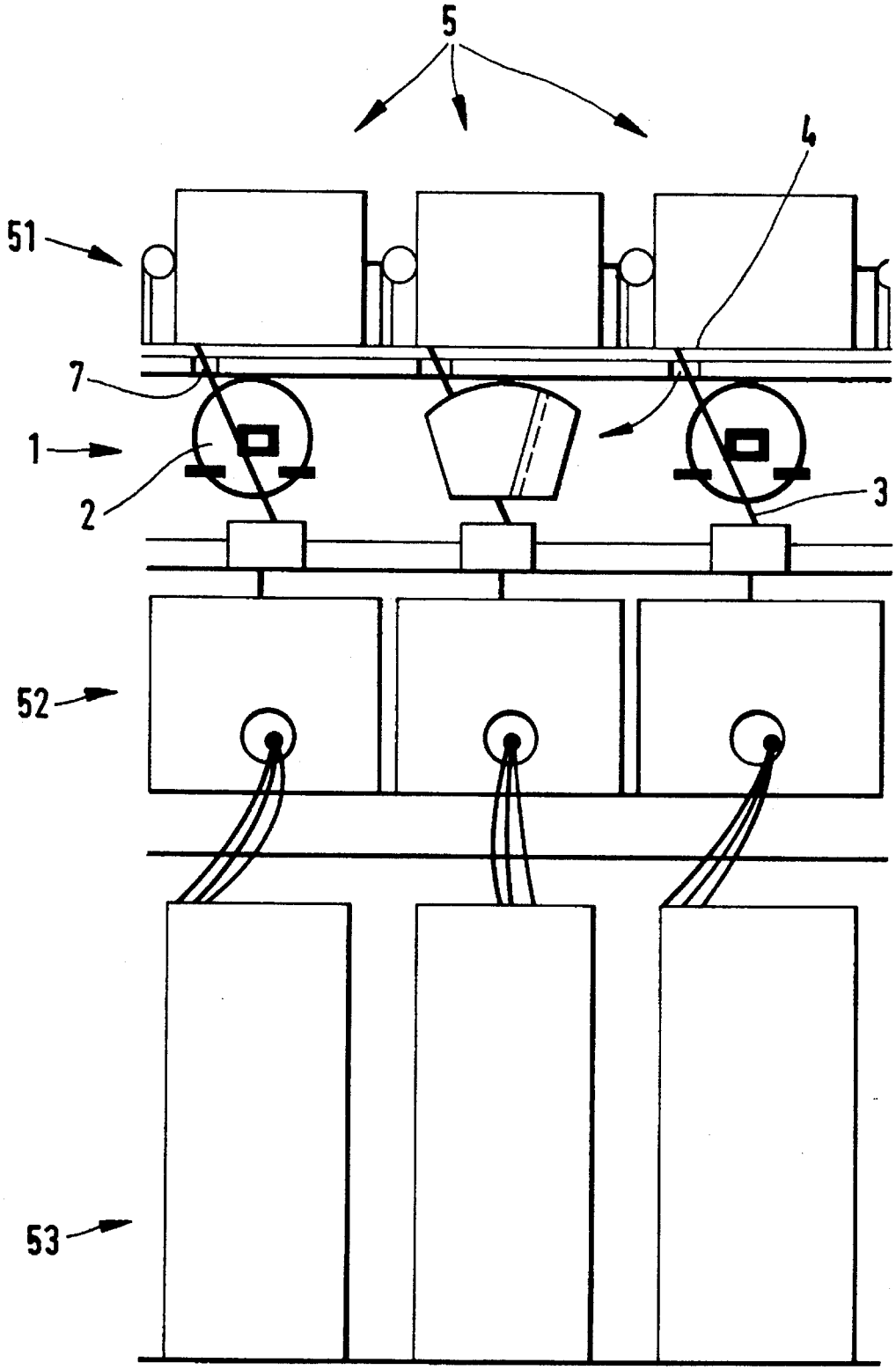
FIG. 1 shows a view of three spinning stations of an open-end rotor spinning machine with paraffining device.

FIG. 1 shows as an example a partial view of an open-end rotor spinning machine in which three spinning and winding stations 5 are shown. The invention can however be used advantageously on all textile machines where a yarn is to be paraffined, in particular by means of a solid paraffin piece. Each of the shown spinning and winding stations 5 of the rotor spinning machine consists of a winding unit 51 and a yarn forming unit 52 which is in the form of a rotor housing in the case of an open-end rotor spinning machine. Each yarn forming unit 52 is assigned a presentation can 53 with a fiber sliver which is placed below the yarn forming unit 52. From the presentation sliver, a yarn 3 is spun in the yarn forming unit and is wound up into a cross-wound bobbin by means of a yarn guide which goes back and forth. Between the yarn forming unit 52 and the winding unit 51 each of the spinning and winding stations 5 shown here is provided with a paraffining device 1. By means of the latter, the produced yarn 3 is immediately provided with a paraffin layer before it is wound up into a cross-wound bobbin. For this purpose the yarn 3 is not only pulled over the paraffin piece 2 but is at the same time pulled back and forth by the traversing movement of the yarn guide 7 over the front of the paraffin piece at a right angle to the direction of the yarn movement.

Of the shown spinning and winding stations 5, only the one in the middle is provided with a covering 4 according to the invention. The other ones are provided with a paraffining device 1 according to the state of the art.

Figure 2:
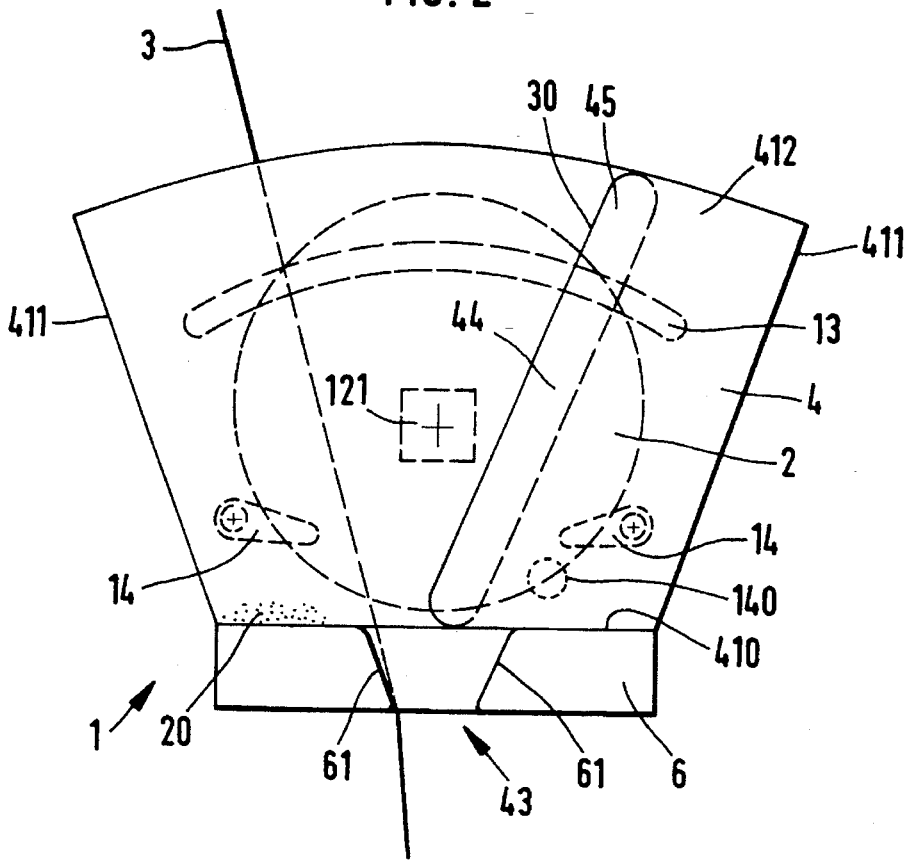
FIG. 2 shows a view of a paraffining device equipped according to the invention, in a frontal view.
Figure 3:
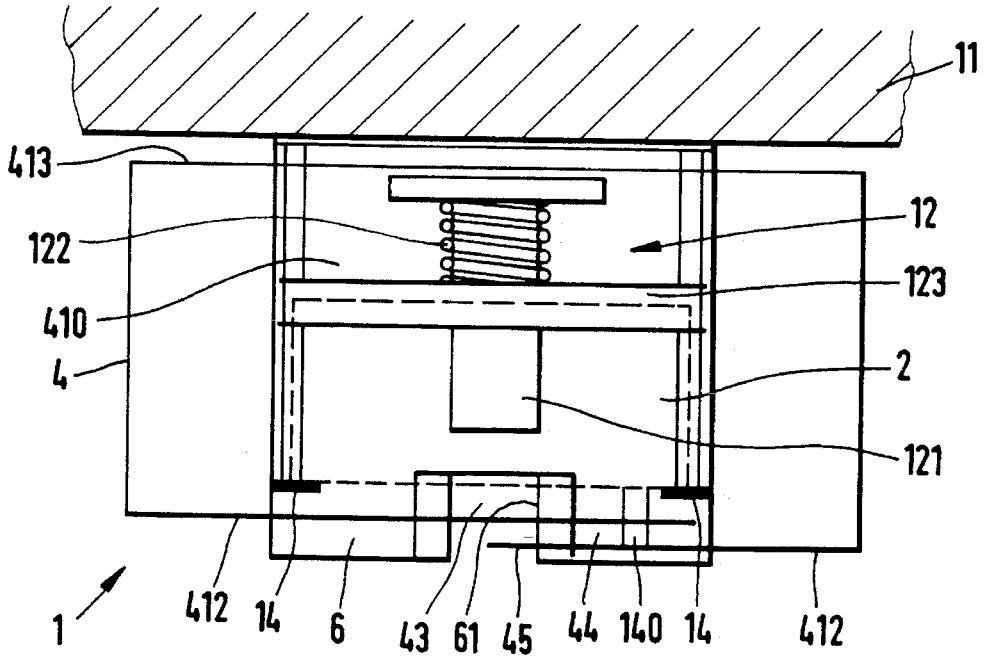
FIG. 3 shows a top view of the paraffining device of FIG. 2.

FIG. 2 shows a paraffining device according to the invention with a covering 4. As can be seen in FIG. 3, the paraffining device 1 consists substantially of a paraffin piece 2 which is held in a seat 12. For this purpose it is pushed on a square 121 of the seat 12. It is at the same time rotated by the seat in order to ensure uniform removal of the paraffin by the yarn running over it. The paraffin piece 2 is covered by the covering 4 according to the invention on all sides up to the top. It is however of course also possible to cover the top by means of a lid, whereby care must only be taken that a slit remains open through which the yarn traversing back and forth over the paraffin piece is able to emerge from the covering above the paraffin piece. As a rule it is however sufficient if the paraffin piece is covered on its other sides by the covering 4. Free paraffin particles 20 which may be produced during the operation of the paraffining device 1 are prevented by the covering 4 from leaving the vicinity of the paraffining device 1, so that they cannot interfere with the yarn formation and the winding of the yarn. Free paraffin particles 20 are produced by the contact between the paraffin piece 2 and the yarn 3 or its axial stops 14 or through the fact that the paraffin particles drop away from an already paraffined yarn 3. This latter event occurs especially when the yarn 3 is guided over a deflection point which, seen in the path of the yarn, is installed after the contact point between yarn and paraffin piece.

In the present example of a paraffining device, the deflection point is the hoop 13 over which the yarn 3 is guided after having come into contact with the paraffin piece 2. In this embodiment of a paraffining device 1, the covering 4 is designed in an especially advantageous manner because at the same time it also covers the hoop 13 which constitutes the first point of contact between the yarn and an assembly after having been paraffined. Due to the fact that the covering 4 covers the paraffin piece on all sides with its surfaces, free paraffin particles 20 are prevented from leaving the paraffining device 1. They are collected on the bottom surface 410 inside the covering 4. Practically all the free paraffin particles 20 produced in the area of the paraffining device 1 are retained and collected by the two lateral surfaces 411, as well as by the forward surface 412 and the rear surface 413. The forward surface 412 is designed so that it can be removed easily so that the covering 4 can be cleaned easily and the paraffin piece, when it has been used up, can be replaced by a new one. As mentioned earlier, a covering can also be provided at the top in extreme cases by means of an appropriately formed covering surface which has an opening or leaves one open for the emergence of the yarn.

In order to enable the yarn to gain access to the paraffin piece 2 during normal operation, the bottom surface 410 is provided with an opening 43 for the entry of the yarn 3 into the space inside the covering 4. If a covering is provided on the top, an opening must be made in it as mentioned earlier, so that the yarn is able to leave the covering 4 of the paraffining device 1 and is not impeded in its traversing movement over the front of the paraffin piece. In the present embodiment the bottom surface 410 is formed by the top of the yarn monitoring device 6. The area of the yarn monitoring device 6 which contains the contact-less sensor at the same time constitutes the opening 43 for the admission of the yarn into the area inside the covering 4. The yarn monitoring device 6 is provided with edges 61 against which the yarn presses when it reaches its reversal points during the back-and-forth winding. The edges 61 are designed so that they are wear-resistant against the contact with a running yarn. Through this configuration of the edges 61 of the opening 43 it is advantageously possible to make them so small that only a minimal passage surface is available to dropping, free paraffin particles 20. Also, a small opening 43 in the bottom surface 410 has the advantage that the free fiber ends sticking away from the running yarn 3 pull along free falling paraffin particles so that instead of falling down from the paraffining device, they come to lie on the bottom surface 410 next to the opening 43. This design of the opening 43, with its small passage surface, prevents the paraffin particles 20 from dropping down from the paraffining device in spite of the presence of opening 43.

It is known that yarn breakage occurs in yarn production or when a yarn is being wound up on a winding machine and is corrected by recombining the free yarn ends with each other or piecing the yarn anew in open-end spinning machines. In practice this is usually accomplished by an automatic servicing device. For this the yarn must be unwound from the bobbin of the winding unit 51 and must be handled outside the paraffining device. To return the textile machine to its normal state, the yarn, after having been handled by the servicing unit, must be brought back as rapidly as possible to the area of the paraffining device so that the yarn is immediately paraffined again so as to avoid long segments of non-paraffined yarn being wound up on the bobbin. To achieve this, the covering 4 according to the invention of the paraffining device 1 of FIG. 2 is provided with a yarn insertion opening 44 through which the yarn 3 is brought back into contact with the paraffin piece 2 immediately upon resumption of the normal process on the textile machine. The yarn insertion opening 44 is formed in that the forward surface 412 is made up of two parts which are placed at a distance from each other. This distance constitutes a yarn insertion opening 44 in the form of a slit in the forward surface 412 of the covering 4. The yarn insertion opening 44 is here inclined so that when the yarn reaches it as a result of its back-and-forth movement over the forward surface 412 of the covering 4, it arrives in the area of the opening at least substantially over its entire length so that it is pulled by its own yarn tension through the yarn insertion opening 44 onto the paraffin piece 2. In FIG. 2 the course of the yarn 3 is drawn so that it comes to lie in the area left of the center of the paraffining piece. The yarn 3 in FIG. 2 is also guided towards the right side into the right half of the paraffin piece as a result of the constant traversing movement. If the yarn 3 is still outside the covering 4 as is the case, for example, after piecing of a broken yarn in an open-end rotor spinning machine, the yarn 3 is automatically guided back through the yarn insertion opening 44 onto the paraffin piece 2.

The forward surface 412 of the covering 4 of FIG. 2 is formed in this case so that the right half extends beyond the left half in the direction of the viewer, so that a yarn catching device 30 is formed which securely conveys the yarn 3 to the yarn insertion opening 44. Because the two front surfaces 412 overlap, the right half constitutes a covering shutter 45 for the yarn insertion opening 44 so that free paraffin particles 20 are prevented from leaving the vicinity of the covering 4 of the paraffining device 1 through the yarn insertion opening 44.

A top view of the paraffining device of FIG. 2 is shown in FIG. 3. The paraffin piece 2 represented by broken lines 2 has a perforation with a square cross-section by which it is pushed on the square piece 121 of the seat 12. It is pushed via spring 122 by means of the seat plate 123 against the stops 14. This ensures that it will always assume the same position in relation to the yarn, no matter how much paraffin has already been removed. Seat 12 is attached to a support 11 which is part of a textile machine. The square piece 121, and with it the paraffine piece 2, is rotated by means of a driving device which is not shown.

The yarn monitoring device 6 which is also mounted on the support 11 constitutes at the same time the bottom surface 410 of the covering 4 of the paraffining device 1. The other surfaces of the covering 4 are held by the yarn monitoring device 6. The covering 4 consists of several surfaces positioned in relation to each other and surrounding the paraffin piece 2. The covering 4, in addition to the bottom surface 410, is provided with a left and a right lateral surface 411, a forward surface 412 and the rear surface 413. The bottom surface 410 has an opening 43 through which the running yarn reaches the paraffin piece 2 on the inside of the covering 4. The opening 43 is constituted by the sensor zone of the yarn monitoring device 6. The edges 61 restrict the back-and-forth movement of the traversing yarn. As a result the yarn is pressing against the edges 61 during its movement, so that these are of wear-proof design. At the same time this makes it possible for the opening 43 to be made so small that practically no opening through which they could fall is available to the free paraffin particles. They are deposited instead on the horizontal bottom surface 410. The forward surface 412 is thus parallel to the front of the paraffin piece 2 which also substantially constitutes a plane in which the yarn moves over the paraffin piece in its back-and-forth movement. The forward surface 412 is made in two parts, with the left half being placed closer to the support 11 than the right half. This creates the yarn insertion opening 44. With identical distance between the two parts of the forward surface 412 from the support 11, a slit-shaped yarn insertion opening 44 would be created which would be equally functional. With the design as shown in FIG. 3, the right side of the forward surface 412 constitutes at the same time a covering shutter 45 which prevents free paraffin particles from leaving the zone of the covering 4 through the yarn insertion opening 44. The yarn insertion opening 44 and the opening 43 are connected to each other so that, for instance, in the piecing of a broken yarn, the latter is able to go at the same time through the yarn insertion opening 44 and through the opening 43 within the covering 4. The hoop 13 in FIG. 2 is not shown in FIG. 3 for the sake of clarity. The stops 14 are attached to the support 11, but it is possible with equal advantage to make them as part of the covering 4, e.g. of the bottom surface 410 or of the forward surfaces 412. Such a stop is shown in FIG. 2 and also in FIG. 3, and bears the reference number 140.

It is especially advantageous to make one of the surfaces of the covering 4 transparent so that the state of the paraffin piece can be ascertained without removing the covering 4. If it is found that the paraffin piece must be replaced, e.g. because too much paraffin has already been removed, the covering 4 is designed for the replacement of the paraffin piece 2 so that it can be opened, swivelled away or removed. It is especially advantageous to design the forward surfaces 412 in this manner. In addition, provisions may be made for the maintenance of the paraffining device to be carried out by the automatic service unit of the textile machine. Thus for example, provisions can be made that it ascertains the state of the paraffin piece. Automatic removal of the free paraffin particles from the covering can also be provided. For this purpose it can be provided with additional openings through which the service unit gains access to the interior of the covering.

It will be apparent to those skilled in the art that various modifications and variations can be made in the present invention without departing from the scope or spirit of the invention. For example, features illustrated or described as part of one embodiment may be substitute in another embodiment to yield still a further embodiment. It is intended that the present invention cover such modifications and variations as come within the scope of the appended claims and their equivalents.

What is claimed is:

1. A paraffining device for a textile machine wherein a horizontally traversing yarn running in a vertical direction is drawn across a paraffin piece of the textile machine, said paraffining device comprising a cover configured to be mounted on the textile machine and comprising a bottom surface, oppositely facing side surfaces, and a front surface, said cover generally surrounding the paraffin piece in order to retain free falling paraffin particles, said cover having an inlet opening defined in said bottom surface and an outlet opening for the traversing running yarn opposite said inlet opening yarn, and further comprising a yarn insertion opening defined in said front surface for bringing the running yarn through said covering adjacent the paraffin piece.

2. The paraffining device as in claim 1, wherein said covering comprises a back surface oppositely facing said front surface, and lateral side surfaces which are essentially perpendicular to said front and back surfaces.

3. The paraffining device as in claim 2, wherein said front surface is parallel to a plane through a traversing path of the yarn across the paraffin piece, and said lateral side surfaces being tapered towards said inlet opening.

4. The paraffining device as in claim 1, further comprising a covering shutter in the area of said yarn insertion opening to cover said yarn insertion opening.

5. The paraffining device as in claim 4, wherein said covering shutter further defines a yarn catching device.

6. The paraffining device as in claim 1, wherein said yarn insertion opening is defined in said front surface of said cover, said opening defined essentially perpendicular to a traversing plane of the yarn across the paraffin piece within said cover.

7. The paraffining device as in claim 1, wherein at least one of said surfaces is removable for replacement of the paraffin piece.

8. The paraffining device as in claim 1, wherein at least one of said surfaces is essentially transparent.

9. A textile machine, comprising:

a paraffin piece mounted on said machine in the course of a vertically running yarn drawn across said paraffin piece in a back and forth horizontal traversing path; and a cover mounted on the textile machine essentially surrounding said paraffin piece in order to retain free falling paraffin particles, said cover having a bottom surface, oppositely facing side surfaces, a front surface, an inlet opening defined in said bottom surface, and an outlet opening for the yarn essentially opposite said inlet opening, and further comprising a yarn insertion opening defined in said front surface by which a running yarn is brought through said covering from outside said covering to be disposed adjacent said paraffin piece.

10. The textile machine as in claim 9, wherein said covering comprises a back surface oppositely facing said front surface, said side surfaces essentially perpendicular to said front and back surfaces, said front surface being parallel to a plane through the traversing path of the yarn across said paraffin piece, and said side surfaces being tapered towards said inlet opening, said bottom surface comprising an essentially horizontal bottom member disposed below the paraffin piece, said inlet opening defined in said horizontal bottom member.

11. The textile machine as in claim 10, further comprising a covering shutter in the area of said yarn insertion opening to cover said yarn insertion opening.

* * * * *